US011845480B2

(12) United States Patent
Richmond

(10) Patent No.: US 11,845,480 B2
(45) Date of Patent: Dec. 19, 2023

(54) SILL CONNECTION FOR RAILCAR STRUCTURE

(71) Applicant: Trinity Rail Group, LLC, Dallas, TX (US)

(72) Inventor: Shaun Richmond, Frankfort, IL (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 622 days.

(21) Appl. No.: 17/018,359

(22) Filed: Sep. 11, 2020

(65) Prior Publication Data

US 2021/0078614 A1 Mar. 18, 2021

Related U.S. Application Data

(60) Provisional application No. 62/899,430, filed on Sep. 12, 2019.

(51) Int. Cl.
*B61F 1/10* (2006.01)
*B61F 1/02* (2006.01)

(52) U.S. Cl.
CPC . *B61F 1/10* (2013.01); *B61F 1/02* (2013.01)

(58) Field of Classification Search
CPC ..... B61F 1/02; B61F 1/08; B61F 1/10
USPC ..... 105/416, 420
See application file for complete search history.

(56) References Cited

U.S. PATENT DOCUMENTS 976,426 A * 11/1910 Becker ..... B61F 1/02 213/51
3,973,681 A * 8/1976 Martin ..... B61F 1/10 213/57
6,148,735 A * 11/2000 Sauter ..... B61D 17/08 105/420
6,244,801 B1 * 6/2001 Klag ..... B61D 3/18 410/24
7,069,864 B2 * 7/2006 Gray ..... B61F 1/02 105/420
8,479,661 B2 * 7/2013 Forbes ..... B61F 1/08 105/245
2010/0258031 A1 * 10/2010 Forbes ..... B61F 1/08 105/355

* cited by examiner

*Primary Examiner* — Zachary L Kuhfuss
(74) *Attorney, Agent, or Firm* — BAKER BOTTS L.L.P.

(57) ABSTRACT

A system for connecting a center sill to a draft sill in a railcar includes a center sill portion that includes a center sill portion top plate, a draft sill portion that includes a draft sill top plate, the draft sill portion having a draft sill cross-section larger than a center sill cross-section of the center sill portion. The system further includes a transition portion between the center sill portion and the draft sill portion, the transition portion includes a transition portion top plate, wherein the transition portion top plate is the same plate as at least one of the center sill portion top plate and the draft sill portion top plate. A method for connecting the center sill to the draft sill in a railcar includes forming the transition portion between the center sill portion and the draft sill portion.

20 Claims, 5 Drawing Sheets

SILL CONNECTION FOR RAILCAR STRUCTURE

RELATED APPLICATION AND CLAIM PRIORITY

This application claims priority to U.S. Provisional Application No. 62/899,430 filed Sep. 12, 2019 and titled "SILL CONNECTION FOR RAILCAR STRUCTURE," which is incorporated herein in its entirety by reference.

TECHNICAL FIELD OF THE DISCLOSURE

This disclosure relates generally to a system and method for railcars, more specifically to a system and method for connecting a center sill to a draft sill in a railcar.

BACKGROUND

In a railcar structure, each car in the railcar may include a center sill in the bottom of the railcar to support the railcar. The center sill may be a box or an open section which runs the length of the railcar and carries longitudinal loads down the railcar. For coupling railcars together, draft gears may be installed at the ends of the center sill via a draft sill, and the draft gears may further be connected with couplers for coupling to another railcar. The movement of railcar elements involves heavy pulling and pushing forces to transport freight as the railcar moves. Therefore, the draft gear provides a cushion to the impacts caused during transportation. However, a connection between the center sill and the draft sill could be fragile under these impacts.

When the center sill is not the same section as the draft sill, the connection has a cross-section to be welded with the center sill at one end and with the draft sill at the other end. The welded portions have low fatigue strength, and therefore, require thicker and heavier plates to reduce work stress and fatigue failures.

SUMMARY

To address the foregoing problems, a system and a method are disclosed herein for connecting a center sill portion to a draft sill portion in a railcar.

Several embodiments are elaborated in this disclosure. In accordance with a particular embodiment, a system for connecting a center sill to a draft sill in a railcar includes a center sill portion that includes a center sill portion top plate and a draft sill portion that includes a draft sill top plate. The draft sill portion has a draft sill cross-section larger than a center sill cross-section of the center sill portion. The system includes a transition portion between the center sill portion and the draft sill portion that includes a transition portion top plate. The transition portion top plate is the same plate as at least one of the center sill portion top plate and the draft sill portion top plate. If the transition portion top plate is the same plate as the center sill portion top plate, a transition between the transition portion top plate and the center sill portion top plate is a first angled bend. If the transition portion top plate is the same plate as the draft sill portion top plate, a transition between the transition portion top plate and the draft sill portion top plate is a second angled bend.

In accordance with particular embodiments, a system for connecting a center sill to a draft sill in a railcar includes a center sill portion that includes a center sill portion top plate, a first center sill portion side plate, and a second center sill portion side plate. The system includes a draft sill portion that includes a draft sill portion top plate, a first draft sill portion side plate, and a second draft sill portion side plate. The draft sill portion has a draft sill cross-section larger than a center sill cross-section of the center sill portion. The system further includes a transition portion between the center sill portion and the draft sill portion. The transition portion includes a transition portion top plate, a first transition portion side plate, and a second transition portion side plate. The transition portion top plate is the same plate as the draft sill portion top plate, and a transition between the transition portion top plate and the draft sill portion top plate is a first angled bend. The first transition portion side plate is the same plate as the first draft sill portion side plate and a transition between the first transition portion side plate and the first draft sill portion side plate is a second angled bend. The second transition portion side plate is the same plate as the second draft sill portion side plate and a transition between the second transition portion side plate and the second draft sill portion side plate is a third angled bend.

In accordance with particular embodiments, a method for connecting a center sill to a draft sill in a railcar includes forming a transition portion between a center sill portion and a draft sill portion, wherein the transition portion includes a transition portion top plate, the center sill portion includes a center sill portion top plate, and the draft sill portion includes a draft sill portion top plate. The transition portion top plate is the same plate as at least one of the center sill portion top plate and the draft sill portion top plate. If the transition portion top plate is the same plate as the center sill portion top plate, a transition between the transition portion top plate and the center sill portion top plate is a first angled bend. If the transition portion top plate is the same plate as the draft sill portion top plate, a transition between the transition portion top plate and the draft sill portion top plate is a second angled bend.

Technical advantages of particular embodiments disclosed herein may include or embody a system and a method for connecting a center sill to a draft sill of a railcar, where a transition portion of the system shares at least one plate with one or both of a center sill portion and a draft sill portion of the system. In other words, at least one plate of the transition portion is the same plate as one or both of the center sill portion and the draft sill portion. As a result, particular embodiments implement solutions to enhance the strength of a connecting system (or a system) between a center sill portion and a draft sill portion in a railcar, and to prevent fatigue failures in the connecting system by coupling the center sill portion and the draft sill portion by a transition portion along the longitudinal axis of the railcar, so that the impacts caused during transportation do not run across the connecting system and damage the connecting system. Furthermore, due to improvements to the connecting system, the structure of the connecting system may be formed by thinner plates to lessen the weight of the connecting system. Certain embodiments may improve the fatigue strength and lessen the weight of the entire structure of the connecting system. For example, particular embodiments provide a connecting system that includes a center sill portion top plate, a draft sill portion top plate, and a transition portion top plate be welded along the longitudinal axis of the connecting system, so that the pulling and pushing forces generated during transportation would not run across the welded portions to damage the linkage between the center sill portion, the transition portion, and the draft sill portion.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Certain embodiments of the present disclosure and inventive concepts, and their features and advantages, may be understood by referring to FIGS. 1 to 5, like numerals being used for corresponding parts in the various drawings.

Particular embodiments of the present disclosure provide an improved a system and a method for connecting a center sill portion with a draft sill portion of a draft gear via a transition portion, to provide a durable, light-weighted structure to a railcar during transportation. The system and method provide for implementing the transition portion, between the draft sill portion and the center sill portion, where the transition portion shares at least one plate with one or both of the center sill portion and the draft sill portion. In some cases that the center sill and draft sill have different cross-sections, and the transition portion may be formed into a size of the draft sill portion at one end and formed into a size of the center sill portion at the other end. Furthermore, in a particular embodiment, a system may comprise one or more extended or added plates to be embedded with a body of the draft sill portion, in order to strengthen the sturdiness and stability of the transitioning connection between the center sill portion and the draft sill portion.

During transportation, a draft gear installed in the bottom of each car faces strong pulling and pushing forces. Such forces could severely impact the connection between the center sill and the draft sill included in the draft gear, and then cause fatigue failures of the connection. Therefore, particular embodiments disclosed in the present application provide a system and a method to provide for a transition portion, between the draft sill and the center sill, that shares at least one plate with one or both of the center sill portion and with the draft sill portion. If the transition portion shares a plate with the center sill portion, the shared plate is bent at a first angle at a transition between the center sill portion and the transition portion without a weld parallel to the first angle. If the transition portion shares a plate with the draft sill portion, the shared plate is bent at a second angle at a transition between the draft sill portion and the transition portion without a weld parallel to the second angle. Some embodiments may be without welds, such as butt welds and t-butt welds, along the cross-sectional axis of the draft sill portion, the center sill portion, and the transition portion, perpendicular to the direction of the railcar transportation. Particular embodiments improve the structural strength without thickening the body of the connecting system between the center sill and the draft sill.

Figure 1:
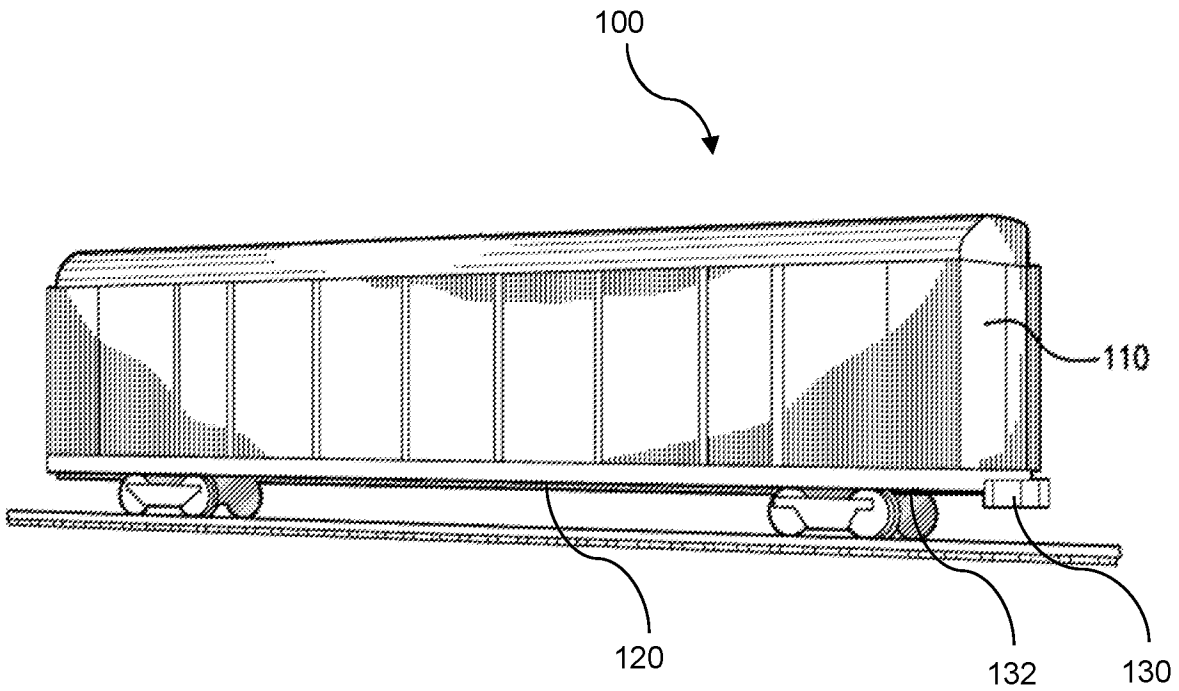
FIG. 1 illustrates an example railcar implemented with a center sill and a draft gear comprising a draft sill.

FIG. 1 illustrates an exemplary car 110 in a railcar 100. Car 110 comprises a center sill 120 and a draft gear 130. Center sill 120 is installed in a bottom of car 110 to support and strengthen a structure of car 110. Draft gear 130 is installed at one or both ends of car 110 to be further coupled with a coupler (not shown), so that car 110 can be coupled with another car or any other element via the coupler. Draft gear 130 comprises draft sill 132 extended towards center sill 120 and connected with center sill 120 to provide a steady linkage between cars coupled together. In particular embodiments, a cross-sectional area of center sill 120 may be different sizes such as 6"×6", 8"×10", etc., depending on car 110 requirements and size. In particular embodiments, a cross-sectional area of draft sill 132 may be different sizes such as 12"×12", 13"×14", etc., depending on car 110 requirements and size. Draft sill 132 is connected with center sill 120 via a system when center sill 120 has a different size of the cross-sectional area than draft sill 132.

Figure 2:
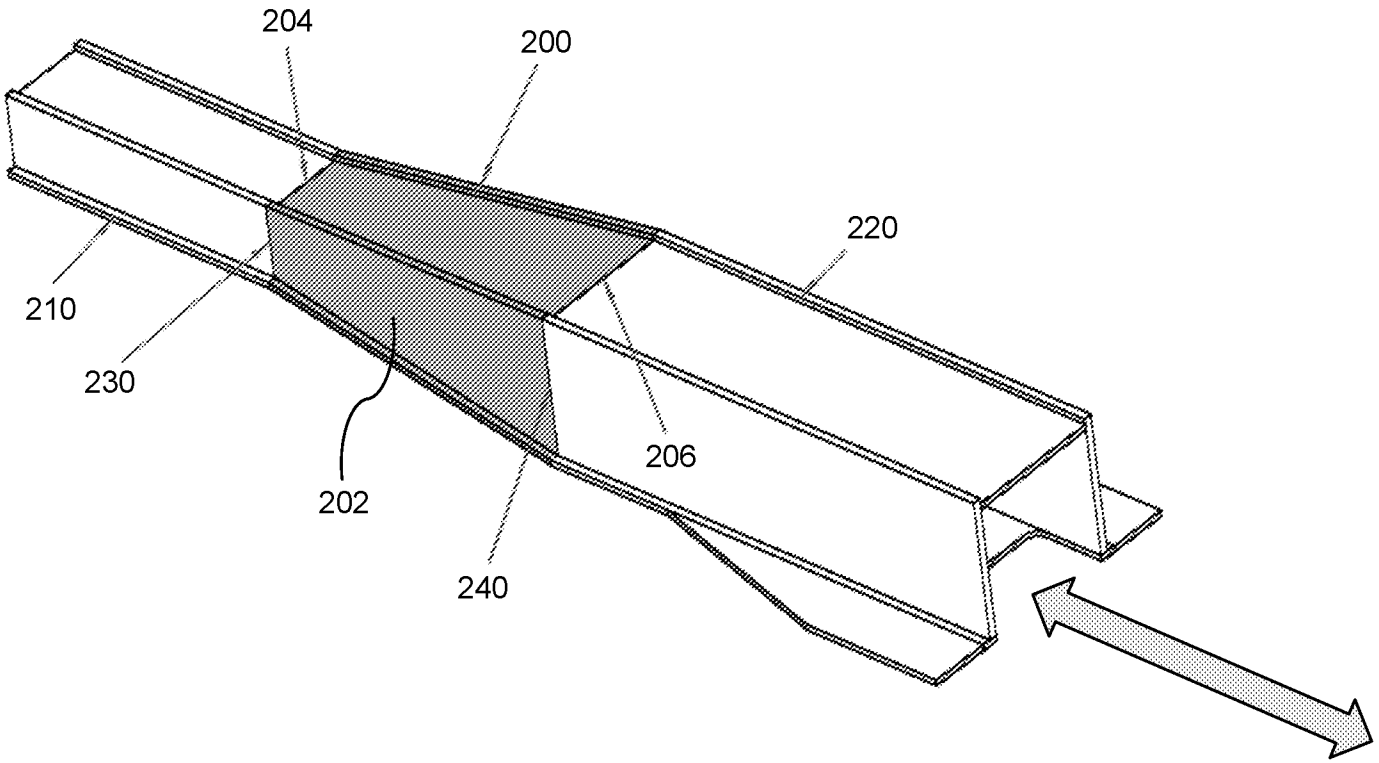
FIG. 2 illustrates a perspective view of a system which connects the center sill and the draft sill.

FIG. 2 illustrates a connection 200 for connecting a center sill portion 210 and a draft sill portion 220. Center sill portion 210 may be a part of center sill 120, and draft sill portion 220 may be a part of draft sill 132, with reference to FIG. 1. In FIG. 2, center sill portion 210 has a smaller cross-sectional area than that of draft sill portion 220. In some railcar systems, center sill portion 210 may have a larger or smaller cross-sectional area than that of draft sill portion 220. When center sill portion 210 is a different size than draft sill portion 220, connection 200 is utilized to couple center sill portion 210 with draft sill portion 220. Connection 200 comprises a body 202 with a first end 204 and a second end 206. First end 204 and second end 206 are located oppositely along a longitudinal axis of connection 200. First end 204 is formed corresponding to the cross-sectional area of center sill portion 210, and second end 206 is formed corresponding to the cross-sectional area of draft sill portion 220. In particular embodiments, body 202 may gradually increase or decrease its cross-sectional area from first end 204 and second end 206 based on the cross-sectional area of center sill portion 210 and draft sill portion 220. Center sill portion 210 may be coupled with first end 204 of body 202 via butt welds 230, and draft sill portion 220 may also be coupled with second end 206 of body 202 via butt welds 240. During transportation, direction of pulling and pushing forces are orthogonal to butt welds 230 and 240. Therefore, the pulling and pushing forces may cause severe fatigue failures onto butt welds 230 and 240 by pulling and pushing draft sill portion 220 directly against butt welds 230 and 240 which are formed transversely across connection 200. Under high stress, the fatigue strength of butt welds 230 and 240 does not increase in proportion to the yield strength of butt welds 230 and 240 and causes fatigue failure. Hence, a thicker connection 200 may be considered but may increase the weight of connection 200.

Figure 3:
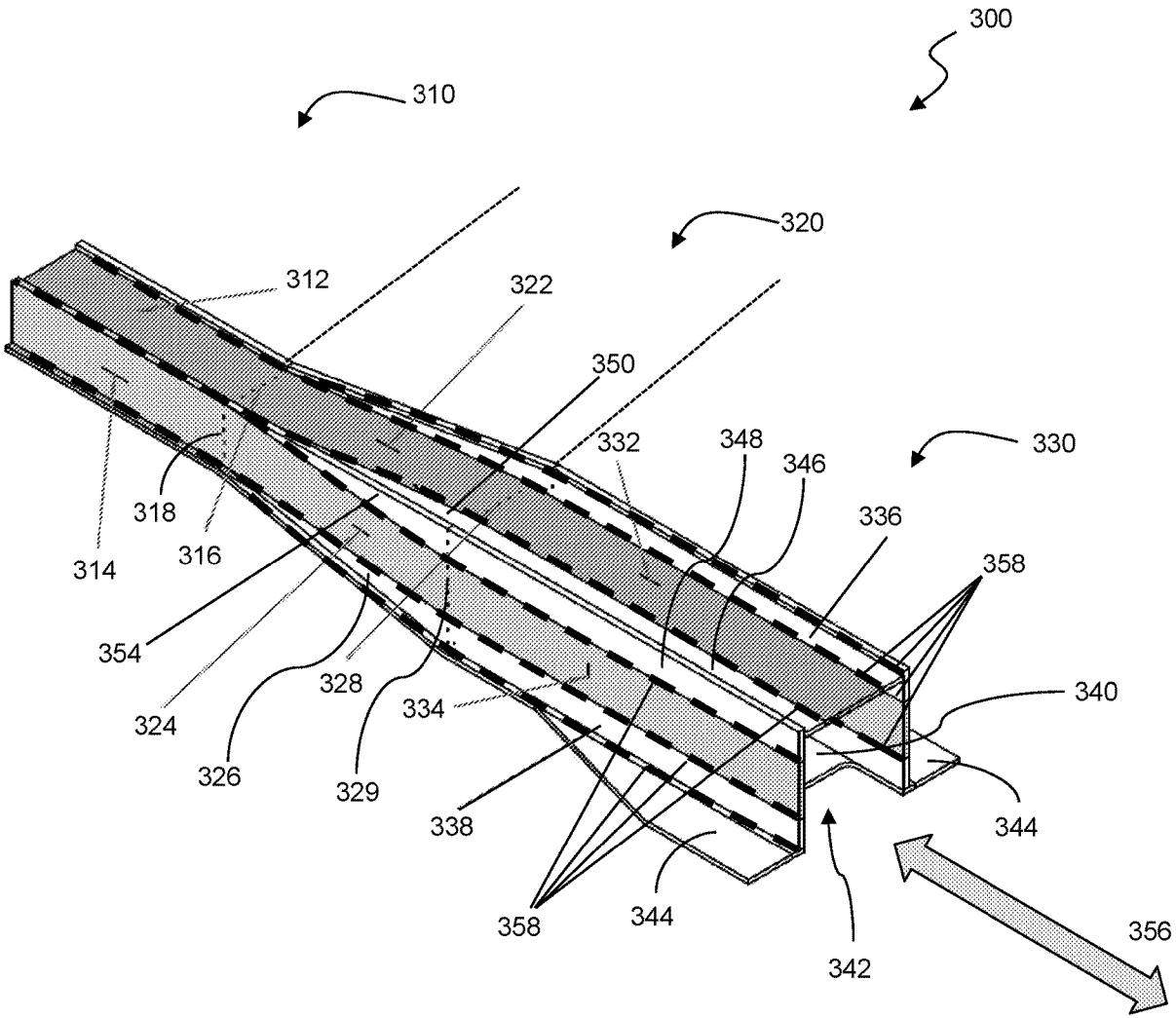
FIG. 3 illustrates a perspective view of an example sill connection system which extends from the center sill and embeds with the draft sill, in accordance with a particular embodiment.

FIG. 3 illustrates an exemplary connecting system 300 for connecting a center sill and a draft sill in a railcar, in accordance with a particular embodiment. In particular embodiments, connecting system 300 may comprise a center sill portion 310, a transition portion 320, and a draft sill portion 330. Transition portion 320 is used to connect or to couple center sill portion 310 to draft sill portion 330. In particular embodiments, one or more of center sill portion 310, a transition portion 320, and a draft sill portion 330 may be an integrated body to connect center sill 120 with draft sill 132 with reference to FIG. 1.

In particular embodiments, center sill portion 310 may comprise a plurality of plates such as a center sill portion top plate 312, a center sill portion first side plate 314, a center sill portion second side plate 440 (See FIG. 4), and a center sill bottom plate 410 (See FIG. 4) to form a hollow rectangular body. Center sill portion 310 may have the same cross-sectional size as center sill 120 and may be expanded from one end of center sill 120. In particular embodiments, center sill portion 310 may be a portion of the center sill 120. In particular embodiments, center sill portion 310 may be used to be connected to center sill 120, thereby it may be sized, formed or chosen to have the same cross-section area as center sill 120. In particular embodiments, center sill portion 310 may have a cross-sectional area of 6"×6", 7"×8" (width and height), or any other suitable size which is applicable to the structure of center sill 120 and/or car 110 with reference to FIG. 1.

In the illustrated embodiment, transition portion 320 is positioned between center sill portion 310 and draft sill portion 330 to connect them. In particular embodiments, transition portion 320 may comprise a plurality of plates such as a transition portion top plate 322, a transition portion first side plate 324, a transition portion second side plate 450 (See FIG. 4), and a transition portion bottom plate 420 (See FIG. 4) to form a hollow rectangular body. In particular embodiments, transition portion 320 may be sized, formed or chosen to accommodate different cross-sections of center sill portion 310 and draft sill portion 330. In this case, transition portion 320 plates may form a smaller hollow rectangular cross-section to match the cross-section of center sill portion 310 at one end and a larger hollow rectangular cross-section to match the cross-section of draft sill portion 330 at the other end.

In particular embodiments, draft sill portion 330 may comprise a plurality of plates such as a draft sill portion top plate 332, a draft sill portion first side plate 334, and a draft sill portion second side plate 460 (See FIG. 4), and a draft sill portion bottom plate 340 to form a hollow rectangular body. Draft sill portion 330 may have the same cross-sectional size as draft sill 132 and may be extended from one end of draft sill 132. In particular embodiments, draft sill portion 330 may be a portion of draft sill 132. Draft sill portion 330 may be used to be connected to draft sill 132, thereby may be sized, formed or chosen to have the same cross-sectional area as draft sill 132. In particular embodiments, draft sill portion 330 may have a cross-sectional area of 12"×12", 13"×14" (width and height), or any other suitable size which is applicable to the structure of draft sill 132, draft gear 130 and/or car 110 with reference to FIG. 1.

Due to failure fatigue causes by welding along the cross-sectional axis of system 300, it is desirable to eliminate the welding in this direction. Hence, the present disclosure includes systems and methods for connecting a center sill (e.g., center sill 120) to a draft sill (e.g., draft sill 132) that minimize welds along the cross-sectional axis of connecting system 300. In particular embodiments, transition portion 320, connecting center sill portion 310 to draft sill portion 330, may share at least one plate with one or both of center sill portion 310 and draft sill portion 330. Particular embodiments minimize a need for welding along the cross-sectional axis of connecting system 300, which results in reduction of failure fatigue caused by butt welds during pulling and pushing forces during transportation or traveling of car 110, and a more reliable and more durable connecting system 300. Furthermore, due to having more durable connecting system 300, thinner plates may be used to form the connecting system 300.

In particular embodiments, transition portion 320 may share at least one plate with one or both of center sill portion 310 and draft sill portion 330. For example, transition portion 320 may share a top plate with at least center sill portion 310 and draft sill portion 330, hence transition portion top plate 322 is the same plate as at least one of center sill portion top plate 312 and draft sill portion top plate 332. In other words, transition portion top plate 322 may be a continuous plate extended from at least one of center sill portion top plate 312 and draft sill portion top plate 332.

In particular embodiments where transition portion top plate 322 is the same plate as center sill portion top plate 312, a transition between transition portion top plate 322 and center sill portion top plate 312 is a first angled bend 316. First angled bend 316 is formed without a weld parallel to first angled bend 316. In other words, the transition portion top plate 322 is bent at a location of first angled bend 316 to accommodate for larger or smaller cross-sectional area of draft sill portion 330 compared to cross-sectional area of center sill portion 310.

In particular embodiments where transition portion top plate 322 is the same plate as draft sill portion top plate 332, a transition between transition portion top plate 322 and draft sill portion top plate 332 is a second angled bend 328. Second angled bend 328 is formed without a weld parallel to second angled bend 328. In other words, the transition portion top plate 322 is bent at a location of second angled bend 328 to accommodate for larger or smaller cross-sectional area of draft sill portion 330 compared to cross-sectional area of center sill portion 310.

In particular embodiments where transition portion top plate 322 is the same plate as both center sill portion top plate 312 and draft sill portion top plate 332, a first transition between transition portion top plate 322 and center sill portion top plate 312 is first angled bend 316 and a second transition between transition portion top plate 322 and draft sill portion top plate 332 is second angled bend 328. In other words, transition portion top plate 322 is a continuous plate extended from both center sill portion top plate 312 and draft sill portion top plate 332; and transition portion top plate 322, center sill portion top plate 312 and draft sill portion top plate 332 are formed by one single plate.

In view of the present disclosure, those skilled in the art will recognize the same or similar method may be applied to other pieces or plates. For example, transition portion 320 may share a side plate with at least center sill portion 310 and draft sill portion 330. In this case, transition portion first side plate 324 is a continuous plate extended from at least one of center sill portion first side plate 314 and draft sill portion first side plate 334. For example, transition portion first side plate 324 may be the same plate as at least one of center sill portion first side plate 314 and draft sill portion first side plate 334. In another example, the transition portion second side plate 450 (See FIG. 4) may be the same plate as at least one of the center sill portion second side plate 440 and the draft sill portion second side plate 460 (See FIG. 4).

In particular embodiments where transition portion first side plate 324 is the same plate as center sill portion first side plate 314, a transition between transition portion first side plate 324 and center sill portion first side plate 314 is a third angled bend 318. Third angled bend 318 is formed without a weld parallel to third angled bend 318. In other words, the transition portion first side plate 324 is bent at a location of third angled bend 318.

In particular embodiments where transition portion first side plate 324 is the same plate as draft sill portion first side plate 334, a transition between transition portion first side plate 324 and draft sill portion first side plate 334 is a fourth angled bend 329. Fourth angled bend 329 is formed without a weld parallel to fourth angled bend 329. In other words, the transition portion first side plate 324 is bent at a location of fourth angled bend 329.

In particular embodiments where transition portion first side plate 324 is the same plate as center sill portion first side plate 314 and draft sill portion first side plate 334, a first transition between transition portion first side plate 324 and center sill portion first side plate 314 is third angled bend 318 and a second transition between transition portion first side plate 324 and draft sill portion first side plate 334 is fourth angled bend 329. In this case, transition portion first side plate 324 is a continuous plate extended from both center sill portion first side plate 314 and draft sill portion first side plate 334; and transition portion first side plate 324, center sill portion first side plate 314 and draft sill portion first side plate 334 are formed from one single plate.

Figure 4:
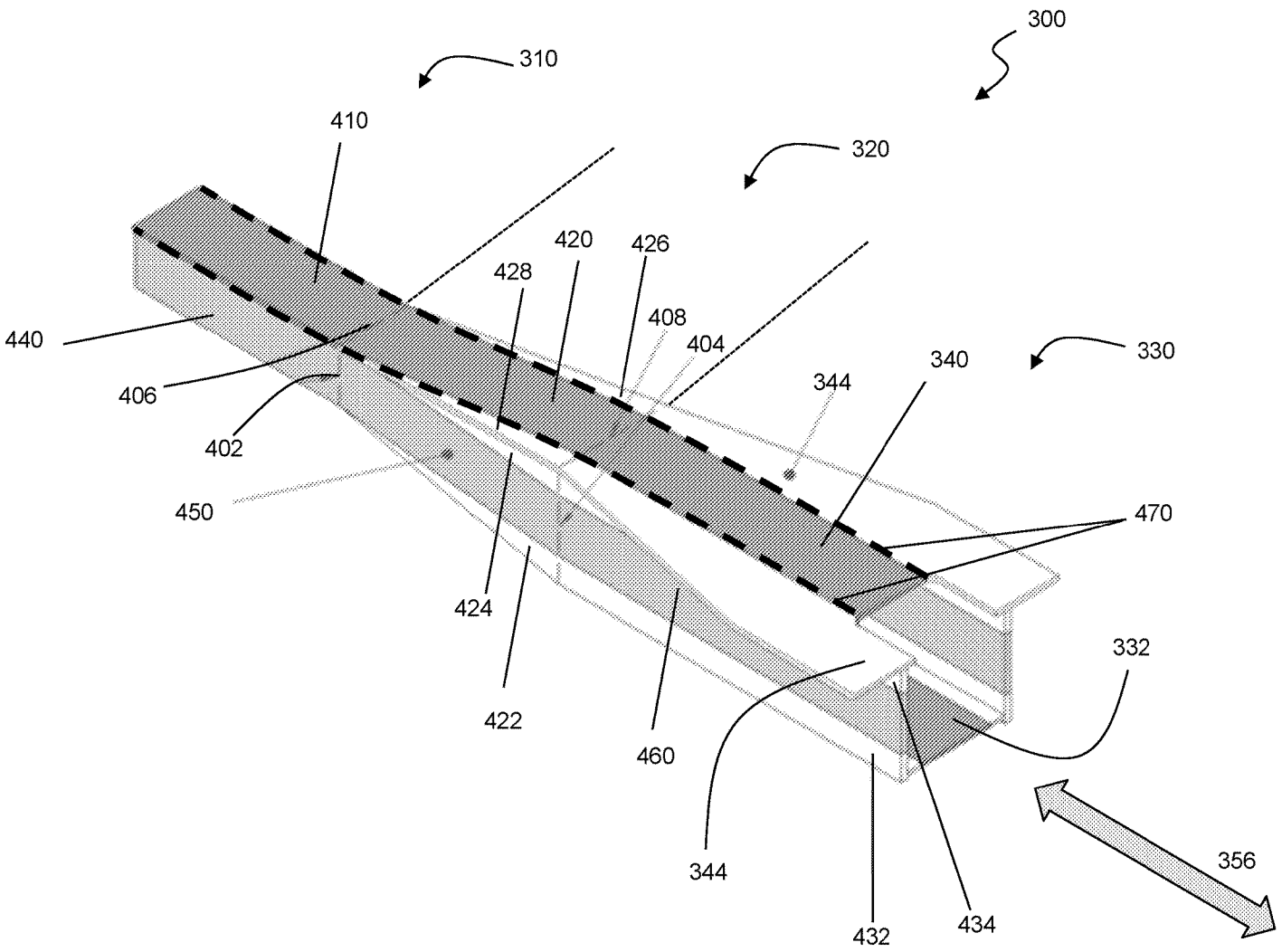
FIG. 4 illustrates another perspective view of an example sill connection system, in accordance with a particular embodiment.

FIG. 4 illustrates another perspective view of system 300, in accordance with certain embodiments. In the illustrated embodiment, center sill portion bottom plate 410, transition portion bottom plate 420, a draft sill portion bottom plate 340, a center sill portion second side plate 440, transition portion second side plate 450, and draft sill portion second side plate 460 are shown. In particular embodiments where the transition portion second side plate 450 is the same as the center sill portion second side plate 440, a transition between the transition portion second side plate 450 and the center sill portion second side plate 440 is a fifth angled bend 402. The fifth angled bend 402 is formed without a weld parallel to the fifth angled bend 402. In other words, the transition portion second side plate 450 is bent at a location of fifth angled bend 402.

In particular embodiments where transition portion second side plate 450 is the same as the draft sill portion second side plate 460, a transition between the transition portion second side plate 450 and the draft sill portion second side plate 460 is a sixth angled bend 404. The sixth angled bend 404 is formed without a weld parallel to the sixth angled bend 404. In other words, the transition portion second side plate 450 is bent at a location of sixth angled bend 404.

In particular embodiments where the transition portion second side plate 450 is the same as the center sill portion second side plate 440 and the draft sill portion second side plate 460, a first transition between the transition portion second side plate 450 and the center sill portion second side plate 440 is the fifth angled bend 402 and a second transition between the transition portion second side plate 450 and the draft sill portion second side plate 460 is the sixth angled bend 404.

In most cases, the center sill portion bottom plate 410 is aligned with the draft sill portion bottom plate 340, thereby the bottom plate is a same flat plate in center sill portion 310, transition portion 320, and draft sill portion 330 (i.e., the center sill portion bottom plate 410, transition portion bottom plate 420, and draft sill portion bottom plate 340 are the same plate plate). However, in a particular embodiment, the center sill bottom plate 410 may not be aligned with draft sill bottom plate 340. As such, the transition portion bottom plate 420 may still be the same plate as at least center sill portion bottom plate 410 and draft sill portion bottom plate 340, however, formed with one or more bend angled transitions. For example, the transition portion bottom plate 420 may be the same plate as the center sill portion bottom plate 410. In this case, the transition portion bottom plate 420 may be bent at a seventh angled bend 406 between the center sill portion bottom plate 410 and the transition portion bottom plate 420. In another example, the transition portion bottom plate 420 may be the same plate as the draft sill portion bottom plate 340. In this case, the transition portion bottom plate 420 may be bent at an eighth angled bend 408 between the draft sill portion bottom plate 340 and the transition portion bottom plate 420.

Referring to FIGS. 3 and 4, in particular embodiment, any combinations of the eight angled bends 316, 318, 329, 238, 402, 404, 406, and 408 may not occur or be needed if their corresponding plates are aligned, resulting in one or more flat continuous plates transitioning from center sill portion 310 to transition portion 320 and/or from transition portion 320 to draft sill portion 330. In particular embodiment, any of the eight angled bends may be placed closer to center sill portion 310 or draft sill portion 330, based on dimensions of center sill 120 and draft sill 132, specification of car 110, and/or any other requirements for railcar 100 with reference to FIG. 1.

It may be obvious to one skilled in the art that any combination of plates may be shared between center sill portion 310, transition portion 320, and draft sill portion 330. In a particular embodiment, transition portion 320 may share four plates with center sill portion 310 and draft sill portion 330. As such, center sill portion top plate 312, transition portion top plate 322, and draft sill portion top plate 332 may be a first plate. Center sill portion first side plate 314, transition portion first side plate 324, and draft sill portion first side plate 334 may be a second plate, the center sill portion second side plate 440. The transition portion second side plate 450, and draft sill portion second side plate 460 may be a third plate, and the center sill portion bottom plate 410, the transition portion bottom plate 420, and the draft sill portion bottom plate 340 may be a fourth plate. Therefore, system 300 may provide more durability and fatigue strength for a railcar and a draft gear, system 300 may be installed therein.

As can be seen in FIGS. 3 and 4, all the welds 358 and 470 (long the dashed lines) are along the longitudinal axis of system 300, in direction of an arrow 356, to eliminate failure fatigue caused by welds along cross-sectional axis of system 300. In other words, all the welds 358 and 470 are parallel to the pulling and pushing forces caused during transportation of car 110 with reference to FIG. 1. The welds 358 and 470 may be any kind of welds, such as butt welds, t-butt welds, and/or the like.

In the illustrated embodiment, center sill portion top plate 312 is welded to center sill portion first side plate 314, the center sill portion second side plate 440, and the center sill bottom plate 410 along the longitudinal axis of center sill portion 310, in direction of an arrow 356.

In particular embodiment where draft sill portion 330 has larger cross-section than center sill portion 310, draft sill portion 330 may also comprise one or more additional or add-on pieces or plates to accommodate for the cross-section difference. The additional plates may include draft sill portion top add-on pieces 336 and 346, draft sill portion first side add-on pieces 338 and 348, draft sill portion second side add-on pieces 432 and 434, and transition portion second side plate add-on pieces 422 and 424.

In the illustrated embodiment, draft sill portion top add-on pieces 336 and 346 are welded to draft sill portion top plate 332 along the longitudinal axis of draft sill portion 330, in direction of arrow 356. Draft sill portion first side add-on pieces 338 and 348 are welded to draft sill portion first side plate 334 along the longitudinal axis of draft sill portion 330, in direction of arrow 356. The draft sill portion second side plate add-on pieces 432 and 434 are welded to the draft sill portion second side plate 460 along the longitudinal axis of draft sill portion 330, in direction of arrow 356. The draft sill portion bottom plate add-on pieces (i.e., flanges 344) are welded to draft sill portion bottom plate 340 along the longitudinal axis of draft sill portion 330, in direction of arrow 356.

In the illustrated embodiment, draft sill portion top plate add-on piece 346 is welded to draft sill portion first side plate add-on piece 348 along the longitudinal axis of draft sill portion 330, in direction of arrow 356. Draft sill portion top plate add-on piece 336 is welded to the draft sill portion second side plate top add-on piece 432. In a particular embodiment where draft sill portion second side plate add-on piece 432 is not used the draft sill portion top plate add-on piece 336 is welded to the draft sill portion second side plate 460 along the longitudinal axis of draft sill portion 330, in direction of arrow 356. In particular embodiments, draft sill portion top plate add-on piece 346 and draft sill portion first side plate add-on piece 348 may be one plate such as a t-shape plate, a l-shape plate, and/or a like. In particular embodiments, draft sill portion top plate add-on piece 336 and a draft sill portion second side plate top add-on piece 432 may be one plate such as t-shape, l-shape plate, and/or a like. The same applies for draft sill portion bottom additional plates (e.g., flanges 344), draft sill portion first side plate add-on piece 338 and a draft sill portion second side plate add-on pieces 432 and 434.

In the illustrated embodiment, the draft sill portion add-on pieces further comprise flanges 344 which are disposed outward from the draft sill portion 330. Flanges 344 may be used to strengthen the structure of draft sill portion 330 and strengthen the connection between draft sill portion 330 with draft sill 132. In particular embodiments, flanges 344 may be welded to draft sill portion first side plate add-on piece 338 and the draft sill portion second side plate add-on piece 434 along the longitudinal axis of draft sill portion 330, in direction of arrow 356. In particular embodiments, one or both flanges 344 may be the same plate as draft sill portion first side plate add-on piece 338 and the draft sill portion second side plate add-on piece 434, such as a t-shape plate, a l-shape plate, and/or a like.

In particular embodiments, any combination of draft sill portion top plate 332, draft sill portion first side plate 334, the draft sill portion second side plate 460, and draft sill portion bottom plate 340 may be formed wider to minimize or eliminate the draft sill portion additional plates.

In particular embodiments where draft sill portion 330 and center sill portion 310 have different cross-sections, transition portion 320 may also comprise one or more additional or add-on pieces or plates to accommodate for the cross-section difference for connecting draft sill portion 330 and center sill portion 310. The one or more additional plates may include transition portion top plate add-on pieces 350 and 352, transition portion first side plate add-on pieces 326 and 350, transition portion second side plate add-on pieces 422 and 424, and transition portion bottom plate add-on pieces 426 and 428.

In the illustrated embodiment, transition portion top plate add-on pieces 350 and 352 are welded to transition portion top plate 322 along the longitudinal axis of transition portion 320, in direction of arrow 356 parallel to the direction of traveling of car 110 with reference to FIG. 1. Transition portion side plate add-on pieces 326 and 354 are welded to transition portion first side plate 324 along the longitudinal axis of transition portion 320, in direction of arrow 356. The transition portion second side plate add-on pieces 422 and 424 are welded to the transition portion second side plate 450 along the longitudinal axis of transition portion 320, in direction of arrow 356. The transition portion bottom plate add-on pieces 426 and 428 are welded to the transition portion bottom plate 420 along the longitudinal axis of transition portion 320, in direction of arrow 356.

In the illustrated embodiment, transition portion top plate add-on piece 350 is welded to transition portion first side plate 324 along the longitudinal axis of transition portion 320, in direction of arrow 356. Transition portion top plate add-on piece 352 is welded to the transition portion second side plate 450 along the longitudinal axis of transition portion 320, in direction of arrow 356. In particular embodiments, transition portion top plate add-on piece 350 and transition portion first side plate add-on piece 354 may be one plate such as t-shape, l-shape plate, and/or a like. In particular embodiments, transition portion top plate add-on piece 352 and a transition portion second side plate add-on piece 422 may be one plate such as t-shape, l-shape plate, and/or a like. The same applies for the transition portion bottom additional plates 426 and 428, transition portion first side plate add-on piece 326, and the transition portion second side plate add-on pieces 422 and 424.

In particular embodiments, any combination of transition portion top plate 322, transition portion first side plate 324, the transition portion second side plate 450, and the transition portion bottom plate 420 may be formed wider on one end to minimize or eliminate the transition portion additional plates or pieces 422, 424, 426, and 428.

Because the welds 358 and 470 are in direction of the longitudinal axis of system 300, along the traveling direction of the railcar (e.g., the welds 358 and 470 are parallel to the pulling and pushing forces caused during transportation), system 300 provides a longer fatigue life and a stronger structure of the railcar since these forces do not impact or affect system 300 directly. Due to an improved design of system 300, system 300 may be a thinner, and therefore lighter structure and still maintain the same or better fatigue strength. System 300 may be made of high strength material, for example, a high strength steel, and/or a like. In particular embodiments, center sill portion 310 may be fabricated from a higher strength material than draft sill portion 330.

In the illustrated embodiment, draft sill portion 330 provides an open end 342 for other parts such as a draft gear, and the draft gear may further be connected to a coupler to be connected to another railcar. Open end 342 may provide a hollow rectangular body that is formed from welding the plates of center sill portion 310, transition portion 320, and draft sill portion 330.

Figure 5:
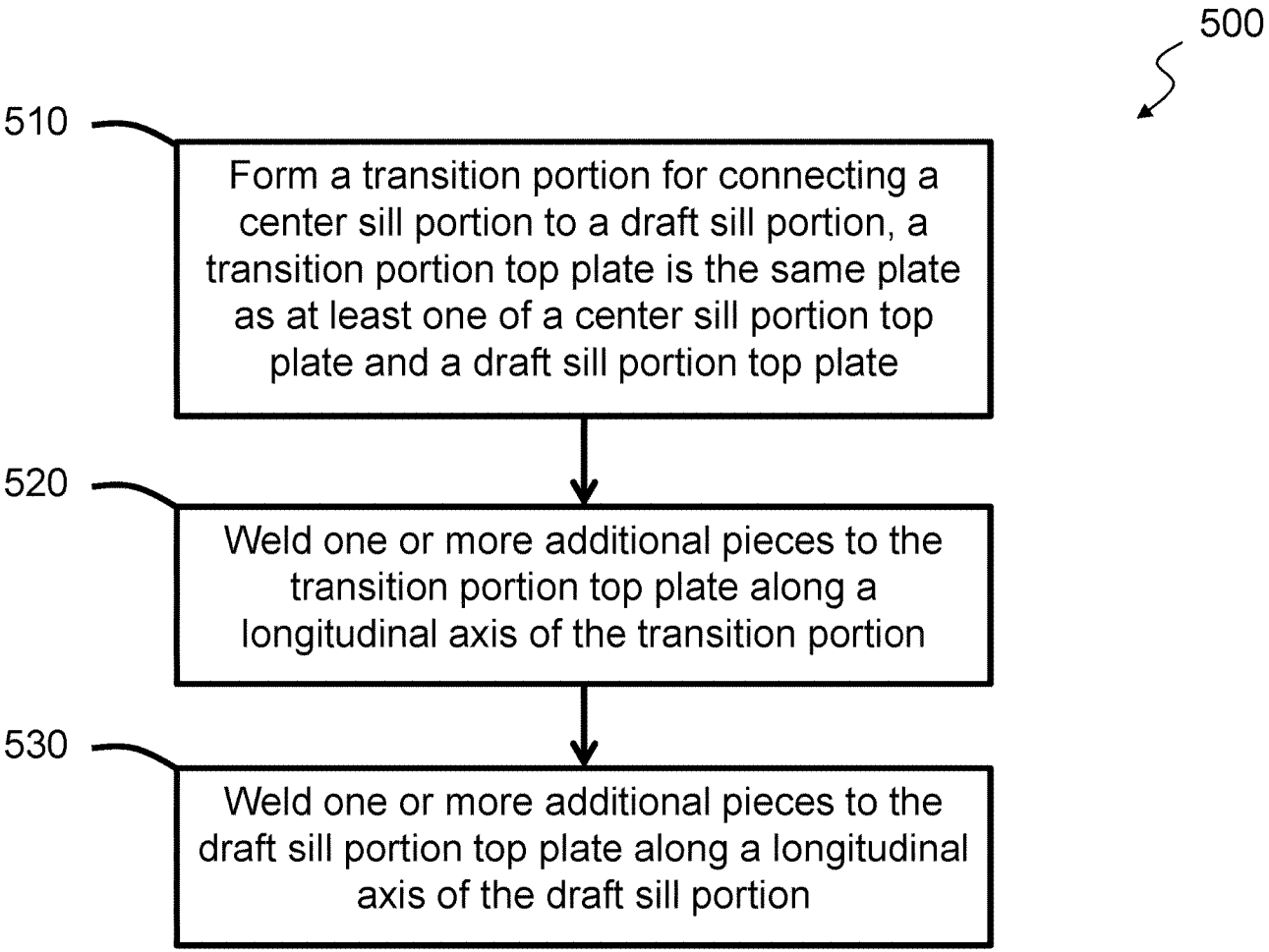
FIG. 5 illustrates a method for connecting a center sill to a draft sill in a railcar, in accordance with a particular embodiment.

FIG. 5 is a flow chart illustrating a method 500 for connecting a center sill to a draft sill in a railcar, in accordance with certain embodiments. Method 500 begins at a step 510 where a transition portion (e.g., transition portion 320) for connecting a center sill portion (e.g., center sill portion 310) to a draft sill portion (e.g., draft sill portion 330) is formed. In particular embodiments, the transition portion may include a plurality of plates such as a transition portion top plate (e.g. transition portion top plate 322), the center sill portion may include a plurality of plates such as a center sill portion top plate (e.g., center sill portion top plate 312), and the draft sill portion may include a plurality of plates such as draft sill portion top plate (e.g., draft sill portion top plate 332). In a particular embodiment, at step 510, the transition portion top plate is formed to be the same plate as at least the center sill portion top plate and the draft sill portion top plate. Method 500 is adapted for the top plate; however, one can determine that method 500 may be adapted for any combination of plates within the scope of the present disclosure. For example, the transition portion may share other plates than the top plate (e.g., the side plate) with at least one of the center sill portion and the draft sill portion. In another example, the transition portion may share more than one plate with at least one of the center sill portion and the draft sill portion. In this case, method 500 may be adjusted to include other plates.

In particular embodiments, the transition portion may be formed to accommodate for different cross-section areas of the center sill portion and the draft sill portion. As such, the transition portion may be formed to have a smaller cross-section to match a cross-section of the center sill portion at one end and a larger cross-section to match a cross-section of the draft sill portion at the other end. In particular embodiments, the transition portion plates may be steel or any type of metal applicable for a vehicle for which the transition portion is used. Transition portion plates may be formed by any metalworking process such as hot rolling and/or a like.

At a step 520, one or more additional pieces or plates are welded to the transition portion top plate along a longitudinal axis of the transition portion. In particular embodiments where the draft sill's cross-section is larger than the center sill's cross-section, additional plates may be needed to be welded to the transition portion to accommodate for the cross-section difference. Thereby, one or more additional plates may be welded to any of transition portion side plates and/or transition portion bottom plate in addition and/or instead of transition portion top plate along a longitudinal axis of the transition portion.

In particular embodiments, the one or more additional plated are welded to the transition portion top plate by any appropriate welding method such as shielded metal arc welding, gas tungsten arc welding, etc. In particular embodiments, one or more transition portion plates may be formed at step 510 such that the one or more transition portion plates' widths gradually become wider to match the cross-section of the draft sill portion. In this case, the need for additional plates is eliminated.

At a step 530, one or more additional pieces or plates are welded to the draft sill portion top plate along a longitudinal axis of the draft sill portion. In particular embodiments where the draft sill's cross-section is larger than the center sill's cross-section, additional plates may be needed to be welded to the draft sill portion to accommodate for the cross-section difference. Thereby, one or more additional plates may be welded to any of draft sill portion side plates and/or draft sill portion bottom plate in addition and/or instead of draft sill portion top plate along a longitudinal axis of the draft sill portion. In particular embodiments, the one or more additional plated may be welded to the draft sill portion top plate by any appropriate welding method such as shielded metal arc welding, gas tungsten arc welding, etc.

In particular embodiments, if the transition portion top plate has the same width as the draft sill portion top plate, there is no need to weld additional plates to the transition portion top plate. In particular embodiments, if the draft sill top plate has the same width as the draft gear, there is no need to weld additional plates to the draft sill portion top plate. The same applies for other plates in the transition portion and the draft sill portion.

According to various embodiments, an advantage of features herein is having a connecting system and method for connecting a center sill to a draft sill in a railcar; where the system includes one or more continuous plates to connect the center sill to the draft sill in the railcar. The system improves the structural durability and avoids the fatigue failures in the railcar during transportation. The system disclosed herein connects the center sill and the draft sill longitudinally to avoid butt welding transversely across the system. Therefore, the system is able to provide a longer fatigue life with a thinner and lighter structure.

Although particular embodiments and their advantages have been described in detail, it should be understood that various changes, substitutions and alternations can be made herein without departing from the spirit and scope of the embodiments. Particular embodiments of the present disclosure described herein may be used or mounted for a railroad car, a semi-trailer, a truck or any other transportations. The illustrations referred to in the above description were meant not to limit the present disclosure but rather to serve as examples of embodiments thereof and so the present invention should only be measured in terms of the claims, which follow.

The invention claimed is:

1. A system for connecting a center sill to a draft sill in a railcar, comprising:

a center sill portion comprising a center sill portion top plate;

a draft sill portion comprising a draft sill portion top plate, the draft sill portion having a draft sill cross-section larger than a center sill cross-section of the center sill portion;

a transition portion between the center sill portion and the draft sill portion, the transition portion comprising a transition portion top plate;

wherein the transition portion top plate is the same plate as at least one of the center sill portion top plate and the draft sill portion top plate;

wherein the transition portion top plate is not welded with the at least one of the center sill portion top plate and the draft sill portion top plate;

if the transition portion top plate is the same plate as the center sill portion top plate, a transition between the transition portion top plate and the center sill portion top plate is a first angled bend; and if the transition portion top plate is the same plate as the draft sill portion top plate, a transition between the transition portion top plate and the draft sill portion top plate is a second angled bend.

2. The system of claim 1, wherein:

if the transition portion top plate is the same plate as the center sill portion top plate, the first angled bend is formed without a weld parallel to the first angled bend; and if the transition portion top plate is the same plate as the draft sill portion top plate, the second angled bend is formed without a weld parallel to the second angled bend.

3. The system of claim 1, wherein the transition portion comprises at least one additional top piece welded to the transition portion top plate along a longitudinal axis of the transition portion.

4. The system of claim 1, wherein the draft sill portion comprises at least one additional top piece welded to the draft sill portion top plate along a longitudinal axis of the draft sill portion.

5. The system of claim 1, wherein:

the center sill portion comprises a first center sill portion side plate and a second center sill portion side plate;

the transition portion comprises a first transition portion side plate and a second transition portion side plate;

the draft sill portion comprises a first draft sill portion side plate and a second draft sill portion side plate;

wherein the first transition portion side plate is the same plate as at least one of the first center sill portion side plate and the first draft sill portion side plate; and wherein the second transition portion side plate is the same plate as at least one of the second center sill portion side plate and the second draft sill portion side plate.

6. The system of claim 5, wherein the transition portion comprises a plurality of transition portion side pieces, each of the plurality of transition portion side pieces welded to either the first transition portion side plate or the second transition portion side plate along a longitudinal axis of the transition portion.

7. The system of claim 5, wherein the draft sill portion comprises a plurality of draft sill portion side pieces, each of the plurality of draft sill portion side pieces welded to either the first draft sill portion side plate or the second draft sill portion side plate along a longitudinal axis of the draft sill portion.

8. A system for connecting a center sill to a draft sill in a railcar, comprising:

a center sill portion comprising a center sill portion top plate, a first center sill portion side plate, and a second center sill portion side plate;

a draft sill portion comprising a draft sill portion top plate, a first draft sill portion side plate, and a second draft sill portion side plate; the draft sill portion having a draft sill cross-section larger than a center sill cross-section of the center sill portion;

a transition portion between the center sill portion and the draft sill portion, the transition portion comprising a transition portion top plate, a first transition portion side plate, and a second transition portion side plate;

wherein the transition portion top plate is the same plate as the center sill portion top plate and a transition between the transition portion top plate and the center sill portion top plate is a first angled bend;

wherein the first transition portion side plate is the same plate as the first center sill portion side plate and a transition between the first transition portion side plate and the first center sill portion side plate is a second angled bend; and wherein the second transition portion side plate is the same plate as the second center sill portion side plate and a transition between the second transition portion side plate and the second center sill portion side plate is a third angled bend.

9. The system of claim 8, wherein:

the first angled bend is formed without a weld parallel to the first angled bend;

the second angled bend is formed without a weld parallel to the second angled bend; and the third angled bend is formed without a weld parallel to the third angled bend.

10. The system of claim 8, wherein:

the transition portion top plate is the same plate as the draft sill portion top plate and a transition between the transition portion top plate and the draft sill portion top plate is a fourth angled bend;

wherein the first transition portion side plate is the same plate as the first draft sill portion side plate and a transition between the first transition portion side plate and the first draft sill portion side plate is a fifth angled bend; and wherein the second transition portion side plate is the same plate as the second draft sill portion side plate and a transition between the second transition portion side plate and the second draft sill portion side plate is a sixth angled bend.

11. A system for connecting a center sill to a draft sill in a railcar, comprising:

a center sill portion comprising a center sill portion top plate, a first center sill portion side plate, and a second center sill portion side plate;

a draft sill portion comprising a draft sill portion top plate, a first draft sill portion side plate, and a second draft sill portion side plate; the draft sill portion having a draft sill cross-section larger than a center sill cross-section of the center sill portion;

a transition portion between the center sill portion and the draft sill portion, the transition portion comprising a transition portion top plate, a first transition portion side plate, and a second transition portion side plate;

wherein the transition portion top plate is the same plate as the draft sill portion top plate and a transition between the transition portion top plate and the draft sill portion top plate is a first angled bend;

wherein the first transition portion side plate is the same plate as the first draft sill portion side plate and a transition between the first transition portion side plate and the first draft sill portion side plate is a second angled bend; and wherein the second transition portion side plate is the same plate as the second draft sill portion side plate and a transition between the second transition portion side plate and the second draft sill portion side plate is a third angled bend.

12. The system of claim 11, wherein:

the first angled bend is formed without a weld parallel to the first angled bend;

the second angled bend is formed without a weld parallel to the second angled bend; and the third angled bend is formed without a weld parallel to the third angled bend.

13. The system of claim 11, wherein:

the transition portion top plate is the same plate as the center sill portion top plate and a transition between the transition portion top plate and the center sill portion top plate is a fourth angled bend;

wherein the first transition portion side plate is the same plate as the first center sill portion side plate and a transition between the first transition portion side plate and the first center sill portion side plate is a fifth angled bend; and wherein the second transition portion side plate is the same plate as the second center sill portion side plate and a transition between the second transition portion side plate and the second center sill portion side plate is a sixth angled bend.

14. A method for connecting a center sill to a draft sill in a railcar, comprising:

forming a transition portion between a center sill portion and a draft sill portion, wherein the transition portion comprises a transition portion top plate, the center sill portion comprises a center sill portion top plate, and the draft sill portion comprises a draft sill portion top plate;

wherein the transition portion top plate is the same plate as at least one of the center sill portion top plate and the draft sill portion top plate;

wherein the transition portion top plate is not welded with the at least one of the center sill portion top plate and the draft sill portion top plate;

if the transition portion top plate is the same plate as the center sill portion top plate, a transition between the transition portion top plate and the center sill portion top plate is a first angled bend; and if the transition portion top plate is the same plate as the draft sill portion top plate, a transition between the transition portion top plate and the draft sill portion top plate is a second angled bend.

15. The method of claim 14, wherein:

if the transition portion top plate is the same plate as the center sill portion top plate, the first angled bend is formed without a weld parallel to the first angled bend; and if the transition portion top plate is the same plate as the draft sill portion top plate, the second angled bend is formed without a weld parallel to the second angled bend.

16. The method of claim 14, wherein the transition portion comprises at least one additional top piece welded to the transition portion top plate along a longitudinal axis of the transition portion.

17. The method of claim 14, wherein the draft sill portion comprises at least one additional top piece welded to the draft sill portion top plate along a longitudinal axis of the draft sill portion.

18. The method of claim 14, wherein:

the center sill portion comprises a first center sill portion side plate and a second center sill portion side plate;

the transition portion comprises a first transition portion side plate and a second transition portion side plate;

the draft sill portion comprises a first draft sill portion side plate and a second draft sill portion side plate;

wherein the first transition portion side plate is the same plate as at least one of the first center sill portion side plate and the first draft sill portion side plate; and wherein the second transition portion side plate is the same plate as at least one of the second center sill portion side plate and the second draft sill portion side plate.

19. The method of claim 18, wherein the transition portion comprises a plurality of transition portion side pieces, each of the plurality of transition portion side pieces welded to either the first transition portion side plate or the second transition portion side plate along a longitudinal axis of the transition portion.

20. The method of claim 18, wherein the draft sill portion comprises a plurality of draft sill portion side pieces, each of the plurality of draft sill portion side pieces welded to either the first draft sill portion side plate or the second draft sill portion side plate along a longitudinal axis of the draft sill portion.

* * * * *